US009388822B2

(12) United States Patent
Roth et al.

(10) Patent No.: US 9,388,822 B2
(45) Date of Patent: Jul. 12, 2016

(54) GUIDE RING FOR AN IMPELLER PUMP AND IMPELLER PUMP

(71) Applicant: E.G.O. Elektro-Geratebau GmbH, Oberderdingen (DE)

(72) Inventors: Stefanie Roth, Hambrucken (DE); Tobias Albert, Kraichtal (DE)

(73) Assignee: E.G.O. Elektro-Gerätebau GmbH, Oberderdingen (DE)

( * ) Notice: Subject to any disclaimer, the term of this patent is extended or adjusted under 35 U.S.C. 154(b) by 822 days.

(21) Appl. No.: 13/766,324

(22) Filed: Feb. 13, 2013

(65) Prior Publication Data

US 2013/0216370 A1 Aug. 22, 2013

(30) Foreign Application Priority Data

Feb. 17, 2012 (DE) ..... 10 2012 202 491

(51) Int. Cl.
*F04D 29/18* (2006.01)
*F04D 29/44* (2006.01)

(52) U.S. Cl.
CPC ..... *F04D 29/18* (2013.01); *F04D 29/448* (2013.01)

(58) Field of Classification Search
CPC ..... F04D 29/444; F04D 29/448
See application file for complete search history.

(56) References Cited

U.S. PATENT DOCUMENTS 5,102,297 A 4/1992 Thompson
6,923,621 B2 * 8/2005 Sato ..... F04D 1/063 415/199.2
7,475,539 B2 1/2009 Chen
2010/0126534 A1 * 5/2010 Busing ..... A47L 15/4225 134/105
2010/0252081 A1 * 10/2010 Classen ..... A47L 15/4206 134/110

FOREIGN PATENT DOCUMENTS

| | | |
|---|---|---|
| DE | 24 46 512 | 4/1976 |
| DE | 4000657 | 7/1991 |
| DE | 10 2010 038 686 | 2/2012 |
| EP | 0 341 553 A1 | 11/1989 |
| EP | 1 219 838 A2 | 7/2002 |
| EP | 2 221 485 | 8/2010 |
| ES | 2207585 | 6/2004 |
| GB | 1081041 | 8/1967 |

OTHER PUBLICATIONS

Mexican Examination Report from Application Serial No. MX/a/2013/001 561 dated Feb. 20, 2015, 4 pages.

(Continued)

*Primary Examiner* — Nathaniel Wiehe
*Assistant Examiner* — Woody A Lee, Jr.
(74) *Attorney, Agent, or Firm* — Lee & Hayes, PLLC

(57) ABSTRACT

A guide ring for a heated impeller pump for dish washers may include a base body in the type of a circumferential ring having a central longitudinal axis and which is configured for arrangement in a pump chamber of the impeller pump. At least one blade may be arranged on a radial outer surface of the base body, which protrudes outwards and which extends longitudinally along the base body over at least a part of the periphery thereof and which has a pitch in relation to the central longitudinal axis. At least on one side of the blade, a protrusion or a thickening may be provided on the outer edge thereof. The latter can form a channel configured to remove air bubbles from the pump chamber.

15 Claims, 4 Drawing Sheets

(56) References Cited

OTHER PUBLICATIONS

European Search Report dated Jun. 12, 2013 in European Application No. 13154757.2.

German Office Action dated Nov. 9, 2012 in DE 10 2012 202 491.3.

Chinese First Office Action from Patent Application No. 201310180097.4 dated Dec. 3, 2015, 5 pages.

* cited by examiner

GUIDE RING FOR AN IMPELLER PUMP AND IMPELLER PUMP

CROSS REFERENCE TO RELATED APPLICATIONS

This application claims the benefit of German patent application DE 10 2012 202 491.3, filed on Feb. 17, 2012, the contents of which are incorporated by reference for all that it teaches.

TECHNICAL FIELD

The disclosure relates to a guide ring for an impeller pump, as being used in particular as heated impeller pump in domestic appliances such as dishwashers or washing machines. Furthermore, the disclosure relates to an impeller pump having such a guide ring.

BACKGROUND

DE 102007017271 A1 discloses a corresponding impeller pump that includes a guide ring radially outside the inlet port in the pump chamber, which serves for improved guidance of the liquid to be heated in the impeller pump or in the pump chamber, respectively.

SUMMARY

The disclosure herein provides a guide ring and impeller pump. According to one aspect, a guide ring for an impeller pump includes a base body shaped as a circumferential ring with a central longitudinal axis, and is configured for arrangement in a pump chamber of the impeller pump. At least one blade is arranged on a radial outer surface of the base body. The blade protrudes outwards and extends longitudinally along the base body over at least a part of a periphery. The blade may have a pitch relative to the central longitudinal axis, and may have a protrusion or thickening arranged on at least one side of an outer edge of the blade.

According to another aspect, an impeller pump may include a guide ring, a pump chamber, an inlet port, and an outlet port. The guide ring may include a base body shaped as a circumferential ring with a central longitudinal axis, with at least one blade arranged on a radial outer surface of the base body. The blade protrudes outwards and extends longitudinally along the base body over at least a part of a periphery. The blade may have a pitch relative to the central longitudinal axis, and may have a protrusion or thickening arranged on at least one side of an outer edge of the blade. The pump chamber may include an impeller rotating within. The inlet port leads into the pump chamber and is directed towards the impeller. The outlet port leads out of the pump chamber. The guide ring may be positioned on an outer face of an elongation of the inlet port in the pump chamber.

These and further features also arise from the description and the drawings as well as from the claims, wherein the individual features are realized in each case on their own or as a plurality in the form of sub-combinations in the case of an embodiment of the disclosure and in other fields and may represent advantageous features which are patentable in their own right and for which protection is claimed in this case. The division of the application into individual sections as well as intermediate headings does not restrict the universality of the statements made therein.

BRIEF DESCRIPTION OF THE DRAWINGS

Embodiments of the disclosure are schematically shown in the drawings and will subsequently be explained in more detail. The drawings show in.

DETAILED DESCRIPTION

Figure 1:
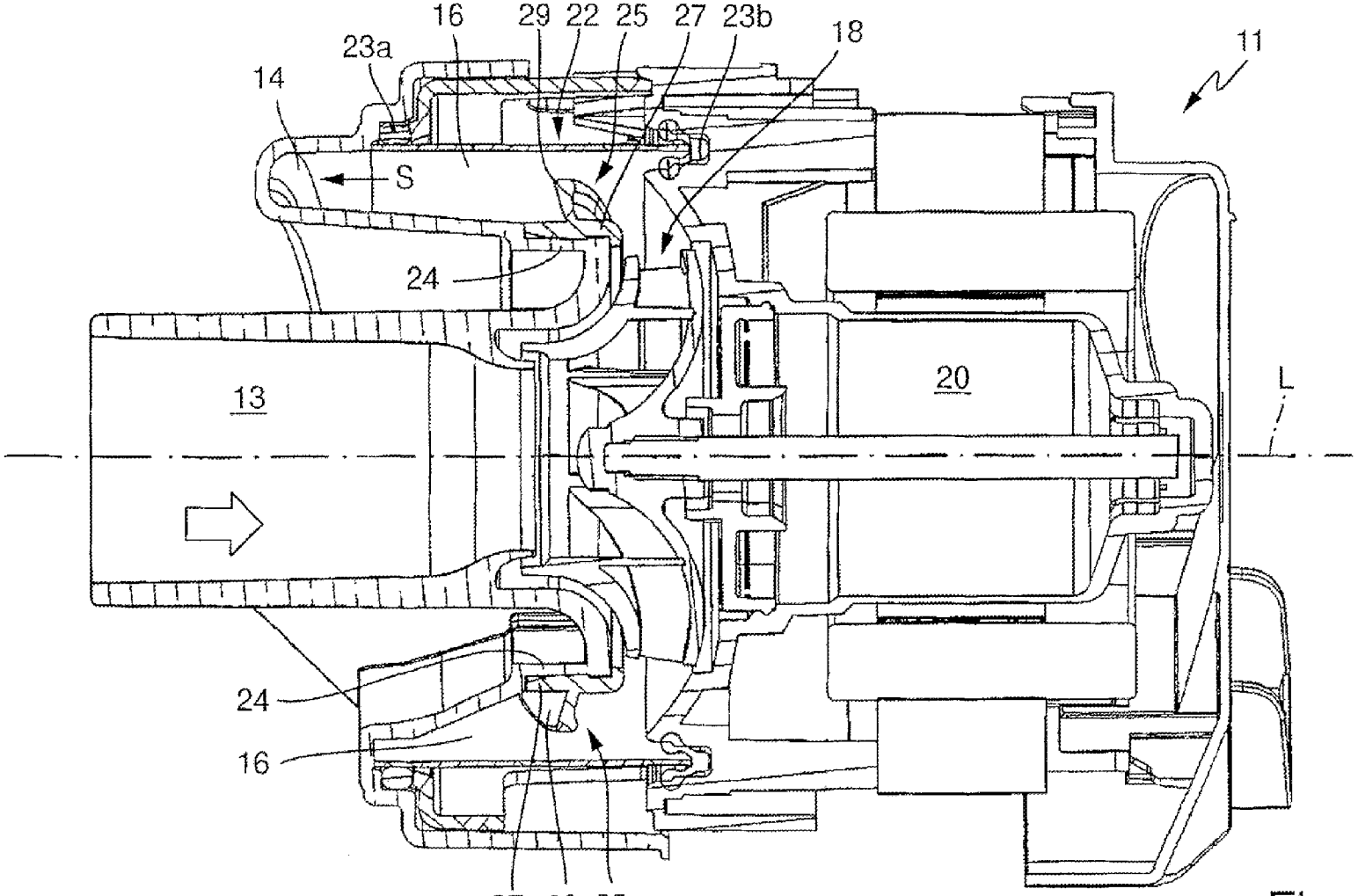
FIG. 1 is a sectional view through an impeller pump having a guide ring according to the disclosure.

The disclosure herein provides an aforementioned guide ring as well as a corresponding impeller pump by means of which problems known from the prior art can be avoided and by means of which in particular a once more improved operation of the impeller pump and of the water guidance, respectively, is possible. Advantageous as well as preferred embodiments of the disclosure are the subject-matter of the further claims and will be explained in more detail in the following. Therein, some of the features are mentioned only for the guide ring or only for the pump. However, irrespective of this, they should be applicable both to the guide ring and to the pump. The wording of the claims is incorporated into the content of the description by explicit reference.

It is provided that the guide ring may include a base body which is configured in the type of a circular ring having a central longitudinal axis to which the base body may be axially symmetric, and which is also configured for arrangement in a pump chamber of the impeller pump. Detailed information on this arrangement will be provided in greater detail below. On a radial outer surface of the base body, at least one blade is arranged, advantageously multiple blades, which protrude(s) outwards and extend(s) longitudinally along the base body over at least a part of the periphery thereof. In this case, the blade has a pitch relative to the central longitudinal axis, advantageously in the type of a helical line.

According to the disclosure, it is provided that at least on one face or on one surface of the blade, respectively, a protrusion or a thickening is provided which can advantageously form a kind of lip. This means that the blade is not only just flat with respect to its cross-sectional area or straight-lined, under certain conditions also slightly tapered towards the outer edge, as known from the prior art. In an advantageous configuration, it is even at least on one side also provided with the protrusion or thickening, which results in a significantly improved degree of efficiency of the water guidance found in the scope of the disclosure. By means of this protrusion or thickening, together with the shape of the rest of the blade, a type of channel can be generated in which air bubbles in the liquid present in the pump chamber can rise in the direction towards the outlet port exiting the pump chamber. Furthermore, individual small air bubbles can collect here and form bigger air packs which in turn then can be transported more rapidly out of the pump due to the significant density difference with respect to the water or the liquid conveyed, respectively. Thus, the problem is solved that by starting the pump or by drawing of air during operation, air can be present inside the pump, which is interfering, and which can be removed therefrom as rapid as possible.

Specifically with heated impeller pumps, in the case of air present in heating elements arranged in the pump chamber or adjoining the same, a heat cushion would in fact develop due to insufficient heat energy absorption by small air bubbles. Such heat cushions can cause breakdown and finally destruction of the pump. For this reason, de-aeration of such a heated impeller pump is desired.

By means of the aforementioned protrusion or thickening on the outer edge of the blade, a diffusor-type behavior or effect can additionally be generated. As a result, a slight pressure increase in the pump chamber develops which, because of the constant performance, leads as well to an improvement of the conveyor effect or of the degree of efficiency of the pump.

In one embodiment, the guide ring can include at least three blades. In an advantageous configuration, there may be four or five blades or even more which run along the outer periphery of the base body. In one configuration, the blades nearly overlap in circumferential direction so that a quasi-continuous blade effect can be generated around the base body of the guide ring. The blades may have the same and continuous width so that their guide function can act in a uniform manner.

In one configuration of the disclosure, the base body has a certain height in the direction of the central longitudinal axis so that a cross-section thereof can quasi be elongate or rectangular with relatively small thickness as compared to the height. At least one blade, advantageously all blades, can extend in the longitudinal course thereof substantially over the entire height of the base body. In one embodiment, the blades are generally in each case configured to be identical.

The blades can advantageously also be configured in such a way that their pitch is substantially constant. As an alternative, they can have a decreasing or increasing pitch in the direction of the central longitudinal axis, i.e., in the direction of the axial flow component of the water conveyed in the pump chamber. As a result, an influencing of exactly these axial flow components is possible and an acceleration of the water can be varied in axial direction. In a further embodiment, it can be provided that the blades do not protrude from the base body in axial direction exclusively, but that they are slightly inclined. In this case, they can have an angle a between 60° and 80° to the central longitudinal axis. In a particularly advantageous configuration, the protrusion or the thickening is arranged on the blade side that has the greater angle to the central longitudinal axis or which is more inclined or angled towards the base body.

In a further embodiment, it can be provided that the thickness or the height of the protrusion or of the thickening decreases, in particular approximately viewed in axial direction, preferably monotonously or continuously. In this case, neither the blade nor the protrusion or the thickening should project beyond the height of the base body in the direction of the central longitudinal axis. A decrease in thickness or in height of the protrusion or of the thickening advantageously runs along the axial direction of the pump opposed to the axial flow component of the water or in said axial direction of the water stream, the height or thickness of the protrusion or of the thickening increases.

At the thickest or highest point, the protrusion or the thickening can approximately be twice the thickness of the blade, particularly advantageous be approximately as thick as the blade and thus form a significantly pronounced lip on the edge. A change in the thickness or in the height of the protrusion or of the thickening can be such that it completely disappears at the thinnest point or that it nearly disappears and is provided on the blade to not more than a minor extent. In an advantageous configuration, the protrusion or the thickening is provided on the edge of the blade or of a blade face. It is advantageous when the protrusion or the thickening is rounded-off in cross-section, namely viewed both radially outwards and radially inwards and also at the highest point. As a result, swirls can be reduced in the conveyed liquid can be reduced.

In another embodiment of the disclosure, the base body is configured substantially as a ring in the type of a short pipe segment. In this case, inner side and/or outer side can be configured to be straight and run parallel to the central longitudinal axis. In this case, the diameter of the base body can be approximately 4 times to 10 times the height of the base body. The height of the base body in turn is approximately 4 times to 10 times the thickness of the same. Furthermore, the thickness of the blades can approximately be in the range of the thickness of the base body, advantageously be slightly thinner up to a half or even only a third of its thickness.

In an advantageous configuration, the base body is made of a rather solid material and in particular it is rigid. The preferably integrally-shaped or injection-molded blades are advantageously made of the same material, as an alternative, a two-component injection-molding with blades consisting at least partially of elastic material is conceivable. The protrusion or the thickening is advantageously also integrally molded with the blade, and with particular advantage it is made of the same material.

As described above, the impeller pump according to the disclosure includes a pump chamber in which the impeller is rotating. An inlet port leads into the pump chamber and directed towards the impeller, wherein an outlet port leads out of the pump chamber, in particular at the end of the pump chamber which is axially distal to the impeller. According to the embodiment, an aforementioned guide ring with a protrusion or a thickening is put over an elongation of the inlet port in the pump chamber, namely on the outer side thereof. In this case, the guide ring or the blades thereof, respectively, do not extend up to the radial, outer pump chamber wall, but have a distance thereto which can be between half the width of the blades and up to twice the width of the blades.

Looking now at the figures, in FIG. 1, a pump 11 according to the disclosure is shown in sectional view substantially corresponding in terms of construction to the aforementioned DE 102007017271 A1 to which explicit reference is hereby made, to be a radial pump or impeller pump. It can advantageously be used in a dishwasher or in a washing machine. The pump 11 comprises a pump housing 12 that includes an inlet 13, an outlet 14 and a pump chamber 16. Close to a pump chamber base, a conventional impeller 18 is arranged as pump wheel. It is driven by a pump motor 20 that is not explained in more detail. By rotation of the impeller 18 fluid is drawn to the inlet 13 in axial direction along the longitudinal central axis L of the pump 11 which is shown as a dashed line and ejected by the impeller 18 in radial direction. Then, the fluid is brought into circulation or circulates in the pump chamber 16, namely in the illustration of FIG. 1 left-hand into and right-hand out of the drawing plane, and finally exits on the outlet 14 of the pump 11 after several circulations.

Outwards, the pump chamber 16 is limited by a heating device 22 that also simultaneously forms an aforementioned radial outer pump chamber wall. As can be seen, the heating device 22 as radial outer pump chamber wall seals the pump chamber 16 via two circumferential sealing rings 23*a* and 23*b* or is connected to the pump housing 12 in a sealing manner.

Furthermore, it can be seen that a guide ring 25 according to the disclosure is arranged around the inlet 13 on a pipe socket 24 or rather said guide ring is put onto the pipe socket 24 and fixed there, for example by means of a clamping snug fit. The guide ring 25 comprises a ring-type base body 27 on which multiple blades 29 are provided on the outside thereof projecting therefrom. Their constructional design will subsequently be explained in more detail in connection with FIGS. 2 to 6.

As can be seen from FIG. 1, the blades 29 are arranged slightly inclined or angled to the base body 27, namely they have an angle a of approximately 75° to the longitudinal central axis L or are pitched in the flow direction of the liquid in the pump chamber 16 having the axial flow component S of the ring-type or helically circulating, conveyed water. The angle a is not directly indicated in FIG. 1, but it can be recognized. This is subsequently explained in more detail.

Figure 2:
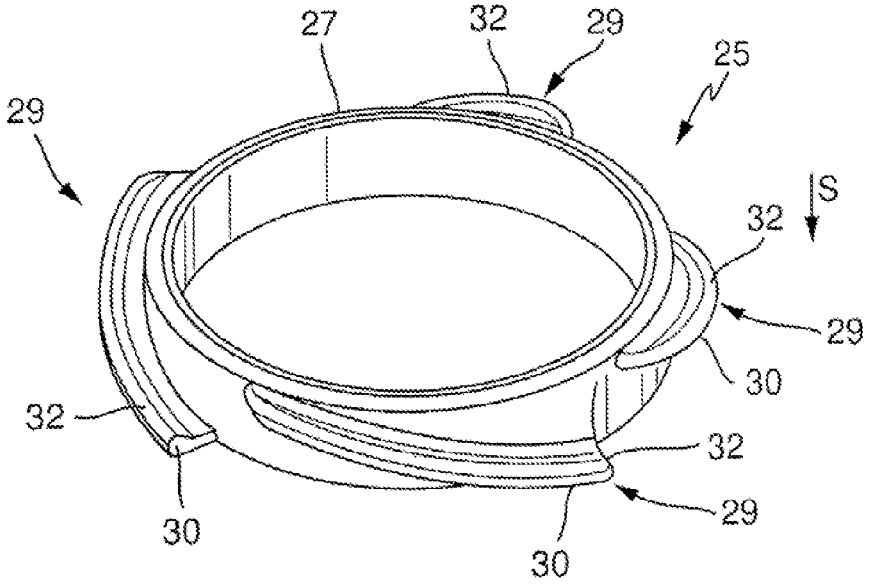
FIG. 2 is an oblique view from below of a guide ring having four blades including lips according to the disclosure.
Figure 3:
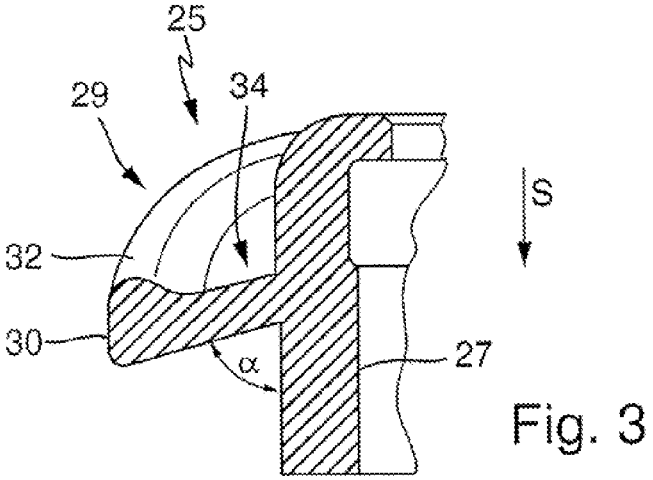
FIG. 3 is a sectional view through a region of the guide ring according to FIG. 2 for illustration of the profile of the lip.

From the inclined view in FIG. 2 can be seen that four blades 29 are arranged on the guide ring 25 having the ring-type base body 27. It can be seen that the blades 29 in each case nearly make a quarter turn around the base body 27 and thus nearly overlap in circumferential direction or nearly meet one another in circumferential direction. The pitch of the blades 29 varies here in relation to the longitudinal central axis L from FIG. 1. In this case, it can be seen at the front blade 29 that initially the pitch is flatter right-hand on the bottom, then there is a strong increase, and then it remains at the same level for a slightly longer region. For comparison, the axial flow component S is marked in there. This means that in the pump 11, the pitch of the blades 29 is slightly greater at the beginning, i.e. close to the pump chamber base 17, and then slightly decreases.

Furthermore, it can already be seen that on an outer edge 30 a protrusion is put or molded on top on the side of the blades 29 as protrusion 32. This can even better also be seen in the enlarged sectional view in FIGS. 3 and 4. Usually, the blade 29 would have approximately a constant thickness up to the outer edge 30. The profile of the blade 29 is altered due to the protrusion 32 shaped integrally on the top which forms a kind of lip. Above all, it can also be seen how—compared to the axial flow component S—a kind of channel 34 is formed between the protrusion 32 and, right-hand inwards, the corresponding outer surface of the base body 27. Said channel 34 improves said removal of air bubbles in the circulating water. On the channel base formed by means of the region of the blade 29 between the base body 27 and the protrusion 32, the air bubbles can especially well collect and accumulate while being removed. Furthermore, they are in any case taken from the inner surface of the heating device 22 and can no longer cause the aforementioned problems of overheating.

Furthermore, it can easily be seen from FIG. 2 that the thickness or height of the protrusion 32 decreases along the course of the blades 29. This is effected in the viewing direction clockwise along the axial flow component S or in the case of the front blades 29 from the bottom right to the top left. In this case, the decrease of the thickness or of the height can be such that it goes down to zero. In view of the illustrations in FIG. 3, the usual thickness of the blades 29 can be approximately 2 mm and the maximum height of the protrusion 32 can be an additional 1 mm to 2 mm.

Figure 4:
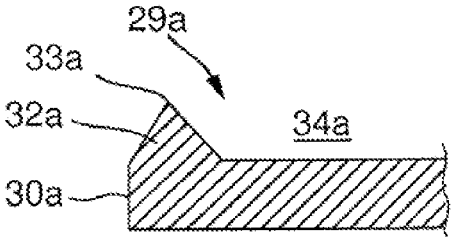
FIGS. 4-6 show three different embodiments for such a lip according to FIG. 3.

As an alternative embodiment of a blade 29*a* having a protrusion 32*a* on the outer edge 30*a* thereof, in FIG. 4 a cross-section is shown which is configured substantially triangular while being edged or pointed. Such a pointed configuration of the cross-section of the protrusion 32 having a real point can cause that a feeding of air bubbles towards the base body 27*a* is improved in the channel 34*a* . The height of the protrusion 32*a* is slightly lower than the thickness of the blade 29*a*.

Figure 5:
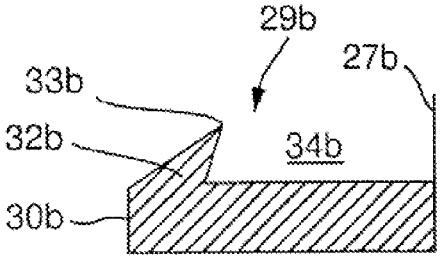
Figure 6:
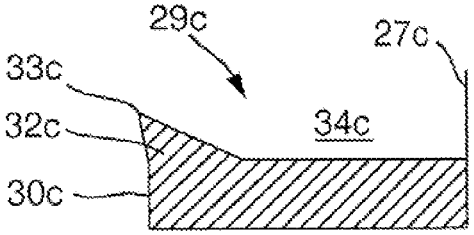

In the variation according to FIG. 5, a protrusion 32*b* is again arranged on the outer edge 30*b* of the blade 29*b* . In this case as well, the protrusion 32*b* is substantially triangular and pointed in the cross-section, with the point 33*b* being strongly inclined inwards over the channel 34*b* towards the base body 27*b* . As a result, the channel 34*b* gets even more closed so to speak. Another embodiment can be seen in FIG. 6 where on a protrusion 32*c* on the outer edge 30*c* of a blade 29*c* the point 33*c* is inclined outwards. In this case, it is inclined in radial direction even beyond the outer edge 30*c* or projects from the same. So, in this case, unlike or in contrast to the embodiment of the channel 34*b* according to FIG. 5, the channel 34*c* is even more exposed. Regarding the variations of the protrusions 32*a* and 32*c*, it is understood that they can also be less pointed or that the points 33*a* to 33*c* are configured to be more rounded-off.

Figure 7:
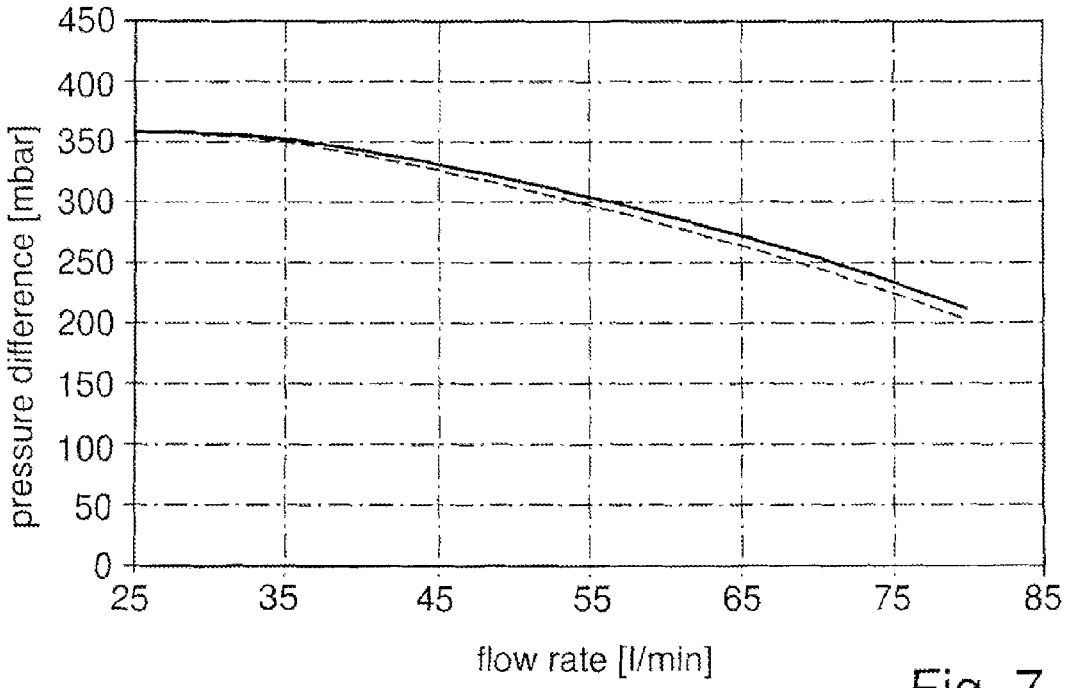
FIG. 7 shows a pump characteristic curve of an impeller pump once with a conventional guide ring and again with a guide ring according to the disclosure.

The diagram of FIG. 7 shows how in case of the dashed curve, the pressure difference plotted against the through-flow rate performs with a guide ring known from the prior art, for example corresponding to the aforementioned DE 102007017271 A1, compared to a guide ring according to the disclosure having a protrusion or a lip on the outer edge 30 of the blade 29 by the solid curve. The upper curve shows the pressure difference for an exemplary pump for the guide ring according to the disclosure. It can be seen that, although only slightly, after all this curve runs clearly above the other curve. Especially by means of an increase of the through-flow rate, the pressure difference can still be slightly increased, in particular reach 5 mbar or even slightly more than 10 mbar, and thus cause an improvement of a few percent.

Figure 8:
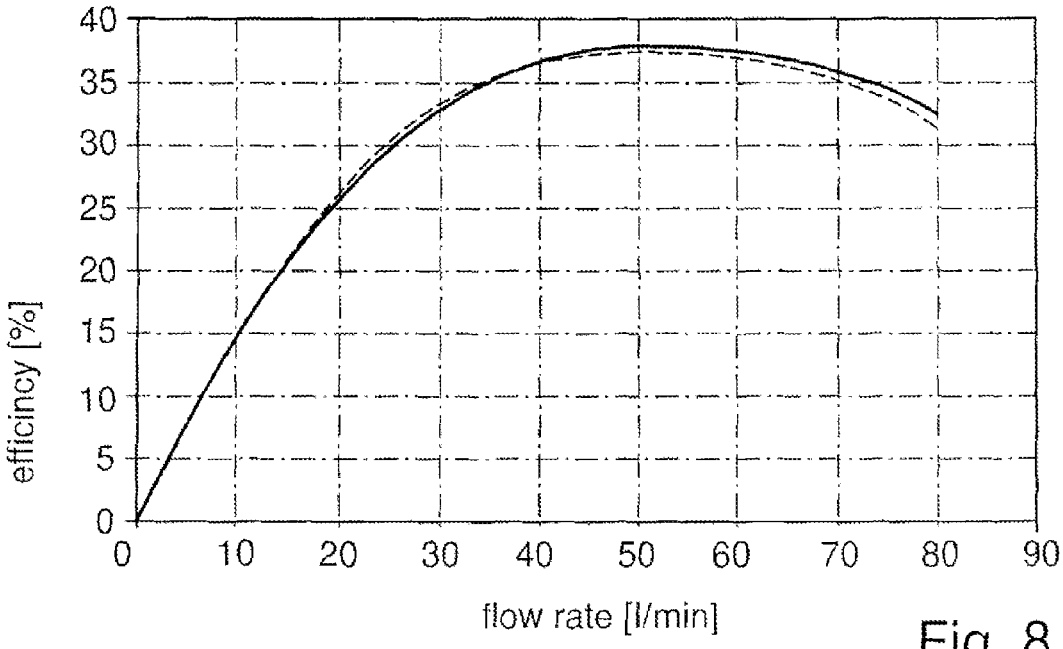
FIG. 8 shows the hydraulic degree of efficiency plotted against the through-flow rate.

In FIG. 8, in each case the hydraulic degree of efficiency for the two guide rings is plotted according to FIG. 7. Here, it can be seen that, since an increased power demand could not be determined in the measurements at the pump, from a volume stream of approximately 40 l/min the hydraulic degree of efficiency is slightly improved, namely between 0.4% and almost 1%. Thus, an advantage can be achieved especially in case of greater flow rates.

Figure 9:
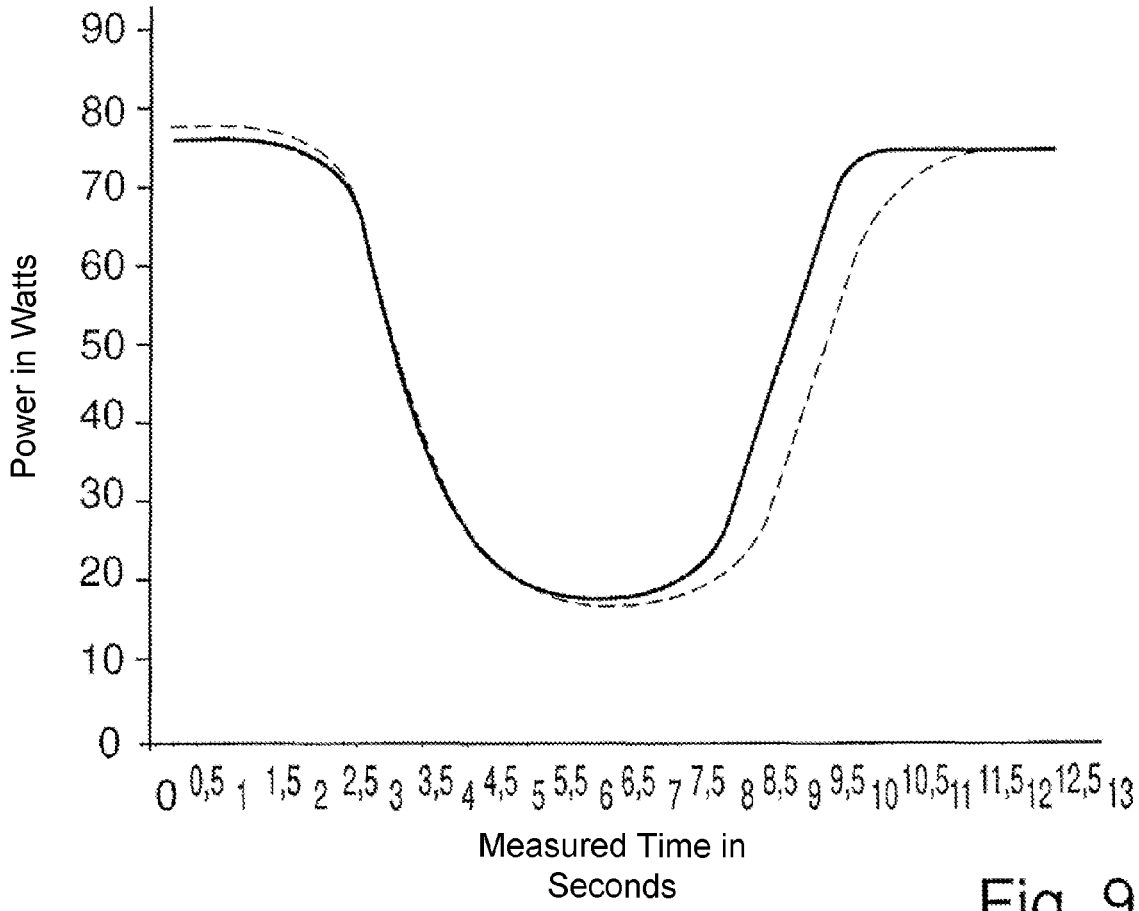
FIG. 9 shows the power characteristic plotted against the time for de-aeration of the pump chamber.

In FIG. 9, in each case the characteristic of the required power is plotted against the time for a de-aeration process in the pump 11, i.e., when air bubbles are present in the water conveyed there. Here, it can be seen that what is revealed by the power characteristic is that in the case of a guide ring according to the disclosure having a protrusion on the blades, de-aeration is terminated earlier or was effected earlier due to the more rapid power increase.

The invention claimed is:

1. A guide ring for an impeller pump, comprising:

a base body shaped as a circumferential ring with a central longitudinal axis, and configured for arrangement in a pump chamber of said impeller pump; and at least one blade arranged on a radial outer surface of said base body, said at least one blade protruding outwards and extending longitudinally along said base body over at least a part of a periphery thereof and having a pitch relative to said central longitudinal axis, wherein a protrusion or thickening is arranged on at least one side of said blade on an outer edge thereof, wherein said blades are inclined with respect to said central longitudinal axis, and wherein said protrusion or thickening is arranged on that side of said blade having a larger angle to said central longitudinal axis.

2. The guide ring of claim 1, wherein the at least one blade comprises at least three blades.

3. The guide ring of claim 1, wherein said base body comprises a height in a direction of said central longitudinal axis, and wherein at least one said blade extends in a longitudinal dimension approximately over the height of said base body.

4. The guide ring of claim 1, wherein said at least one blade comprises a substantially constant pitch in a longitudinal dimension.

5. The guide ring of claim 1, wherein said blades project from said base body in an angle between 60° and 80° to said central longitudinal axis.

6. The guide ring of claim 1, wherein said thickness of said protrusion or said thickening constantly decreases along a longitudinal dimension of said blade.

7. The guide ring of claim 6, wherein neither said blade nor said protrusion or said thickening project beyond a height of wherein base body in a direction of said central longitudinal axis.

8. The guide ring of claim 1, wherein said thickness of said protrusion or thickening decreases from a maximum of twice a thickness of said blade down to zero.

9. The guide ring of claim 1, wherein said base body is configured substantially as a ring in a type of a short pipe segment.

10. The guide ring of claim 9, wherein said base body is configured substantially as a ring in a type of a short pipe segment having a straight inner surface or outer surface running parallel to said central longitudinal axis.

11. The guide ring of claim 9, wherein said diameter of said base body is approximately 4 times to 10 times a height of said base body.

12. An impeller pump comprising:

a guide ring having a base body shaped as a circumferential ring with a central longitudinal axis, and configured for arrangement in a pump chamber of said impeller pump, and at least one blade arranged on a radial outer surface of said base body, said at least one blade protruding outwards and extending longitudinally along said base body over at least a part of a periphery thereof and having a pitch relative to said central longitudinal axis, wherein a protrusion or thickening is arranged on at least one side of said at least one blade on an outer edge thereof;

a pump chamber having an impeller rotating therein;

an inlet port leading into said pump chamber and directed towards said impeller; and an outlet port leading out of said pump chamber, wherein said guide ring is positioned on an outer face of an elongation of said inlet port in said pump chamber.

13. The impeller pump of claim 12, wherein said thickness of said protrusion or of said thickening increases in a direction facing away from said impeller towards said outlet port along an extension of said protrusion or of said thickening on said at least one blade.

14. The impeller pump of claim 12, wherein said at least one blade comprises one of four or five blades which are substantially consecutive to one another in a circumferential direction.

15. A guide ring for an impeller pump, comprising:

a base body shaped as a circumferential ring with a central longitudinal axis, and configured for arrangement in a pump chamber of said impeller pump; and at least one blade arranged on a radial outer surface of said base body, said at least one blade protruding outwards and extending longitudinally along said base body over at least a part of a periphery thereof and having a pitch relative to said central longitudinal axis, wherein a protrusion or thickening is arranged on at least one side of said blade on an outer edge thereof, wherein said thickness of said protrusion or thickening constantly decreases along a longitudinal dimension of said blade.

* * * * *